US005813911A

United States Patent [19]

Margolin

[11] Patent Number: 5,813,911

[45] Date of Patent: Sep. 29, 1998

[54] PATTERN KENO GAME

[75] Inventor: Marc Margolin, Culver City, Calif.

[73] Assignee: Bally Gaming, Inc., Las Vegas, Nev.

[21] Appl. No.: 701,309

[22] Filed: Aug. 21, 1996

[51] Int. Cl.[6] ..... A63F 9/22

[52] U.S. Cl. ..... 463/19

[58] Field of Search ..... 463/16, 17, 18, 463/19, 20, 21; 273/138.1, 269; 364/412, 410

[56] References Cited

U.S. PATENT DOCUMENTS

| | | | |
|---|---|---|---|
| Re. 32,480 | 8/1987 | Bolan | 364/410 |
| 3,873,092 | 3/1975 | Fagan | 273/135 B |
| 3,913,921 | 10/1975 | Bourassa | 273/135 B |
| 4,095,785 | 6/1978 | Conner | 273/1 E |
| 4,103,895 | 8/1978 | Pressman et al. | 273/153 R |
| 4,339,135 | 7/1982 | Breslow et al. | 273/237 |
| 4,365,810 | 12/1982 | Richardson | 273/237 |
| 4,373,726 | 2/1983 | Churchill et al. | 273/138 A |
| 5,192,076 | 3/1993 | Komori . | |
| 5,393,057 | 2/1995 | Marnell, II | 463/13 |
| 5,401,024 | 3/1995 | Simunek . | |
| 5,651,735 | 7/1997 | Baba | 463/18 |

*Primary Examiner*—George Manuel
*Attorney, Agent, or Firm*—Fulwider Patton Lee & Utecht, LLP

[57] ABSTRACT

A method and device for playing a game. The device comprising a video screen for displaying a playing board wherein the playing board comprises an array of squares, access for accepting a bet from a player, a selector for a player to select a pattern of squares on the playing board, a template generator, a random number generator for selecting, at random, squares within the playing board, a scanner to calculate the number of randomly selected squares which are contained within the template for each different position in which the template is included within the playing board, a calculator for determining the payout for a winning position and for tallying the winnings and crediting the winnings to the player.

19 Claims, 5 Drawing Sheets

FIG. 1A

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

FIG. 1B

| | | | | | | | | | |
|---|---|---|---|---|---|---|---|---|---|
| ~~1~~ | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | ~~35~~ | 36 | 37 | 38 | 39 | ~~40~~ |
| 41 | 42 | 43 | 44 | 45 | 46 | 47 | 48 | 49 | ~~50~~ |
| 51 | 52 | ~~53~~ | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

FIG. 1C

| | | | | | | | | | |
|---|---|---|---|---|---|---|---|---|---|
| ~~1~~ | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | ~~35~~ | 36 | 37 | 38 | 39 | ~~40~~ |
| 41 | 42 | 43 | 44 | 45 | 46 | 47 | 48 | 49 | ~~50~~ |
| 51 | 52 | ~~53~~ | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

FIG. 2

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

PATTERN KENO GAME

FIELD OF THE INVENTION

The present invention is directed at a game of chance and a device for playing the game.

BACKGROUND OF THE INVENTION

Keno is a game in which a player selects numbers from a grid of eighty squares, with each square numbered from one to eighty in sequence. An example of a keno grid is shown in FIG. 1*a*. The player first determines how many numbers (or "spots") to select. The number of spots selected determines the payout odds. For example, for a five-spot keno game (as shown in FIG. 1*b*), the player selects any five of the eighty numbers and marks them. Then, the machine selects at random, twenty of the eighty numbers (the shaded squares as shown in FIG. 1*c*) . When the machine selects a number that the player also selected, this is known as a "hit". If the player received enough hits to have a winning ticket, the machine then pays off according to an established payoff schedule. For example, the payout odds may be as follows: For $1 wagered, if the player catches three out of five, the player wins $1; if the player catches four out of five as shown in FIG. 1*c*) the player wins $20; and if the player catches all five out of five, the player wins $600.

The above example demonstrates keno as played on a video machine. Keno can also be played using paper tickets (similar to Bingo) and a common board used by multiple players but each with their own paper tickets. In this version of the game, a player marks his ticket with a crayon to indicate his number selections and then registers the ticket with an employee at the keno desk of the casino. This ticket is then played against the next game displayed on the common board, with each player playing independent tickets. The common board merely lights up the twenty random numbers which are selected using numbered ping pong balls (similar to the lottery). The player then reviews his ticket and circles the numbers that both he selected and the ones that were selected at random as displayed on the common keno board. If he received enough hits, as determined by the payout schedule, he would take his winning ticket to the employee at the keno desk for his payoff.

Keno played with paper tickets and a common board differs from video keno in that video keno is played by a single player using his own machine and own number selection process while the former is played by multiple independent players. Also, video keno indicates on a single medium (the eighty number grid) both the spots selected by the player and the spots subsequently selected by the machine, which easily shows the hits and whether or not the ticket is a winner. Video keno is also much faster, with the capability of playing each game in a matter of seconds as opposed to several minutes for a game using paper tickets and a common board.

Another form of keno is way-keno. In way-keno, the player plays multiple games of keno on a single ticket. In playing way-keno, groups of numbers are separated by lines or circles. The groups are then combined together to make individual tickets for all the ways that a player wishes to play (see FIG. 2). The player, in the example shown in FIG. 2, selected four separate groups of numbers and encircled each group. One group contains four numbers, one group contains three numbers and the other two groups contain two numbers each. In this example, the groups are then combined in every possible way to establish each of the games that are played. For instance, the group of four numbers is combined with the group of three numbers to establish a seven-spot game. In FIG. 2, there are fifteen different ways that the groups can be combined to form fifteen different games (or "ways"). Four of the ways played are the individual groups themselves. All of the combinations (games or "ways") being played are listed below in Table I.

In this example, there are a total of fifteen games of keno that are being played on one ticket. If the player decides to play $1 per way ($1 per game), the total price for this way ticket would be $15.

In the example shown, there is one way all four groups can be combined (4+3+2+2) to yield one eleven-spot game; there are four additional ways that three of the four groups can be combined; there are six additional games that two of the four groups can be combined; and finally, each of the groups can be played solo for four additional games to give fifteen games played altogether. Of the fifteen games, there is one eleven-spot, two nine-spots, one eight-spot, two seven-spots, two six-spots, two five-spots, two four-spots, one three-spot and two two-spots.

TABLE I

| Game No. | Groups Used | | | | Spots Played | |
|---|---|---|---|---|---|---|
| 1 | 4 | 3 | 2 | 2 | 11 | All 4 groups used |
| 2 | 4 | 3 | 2 | | 9 | 3 of 4 groups used |
| 3 | 4 | 3 | | 2 | 9 | 3 of 4 groups used |
| 4 | 4 | | 2 | 2 | 8 | 3 of 4 groups used |
| 5 | | 3 | 2 | 2 | 7 | 2 of 4 groups used |
| 6 | 4 | 3 | | | 7 | 2 of 4 groups used |
| 7 | 4 | | 2 | | 6 | 2 of 4 groups used |
| 8 | 4 | | | 2 | 6 | 2 of 4 groups used |
| 9 | | 3 | 2 | | 5 | 2 of 4 groups used |
| 10 | | 3 | | 2 | 5 | 2 of 4 groups used |
| 11 | | | 2 | 2 | 4 | 2 of 4 groups used |
| 12 | 4 | | | | 4 | 1 of 4 groups used |
| 13 | | 3 | | | 3 | 1 of 4 groups used |
| 14 | | | 2 | | 2 | 1 of 4 groups used |
| 15 | | | | 2 | 2 | 1 of 4 groups used |

The player uses the payout schedules for each game independently and adds the winnings for each game independently. Way-keno tickets can have more than one winning game.

Way-keno often involves complicated math just to calculate how many games are being played and how much money is being wagered. In fact, because of its complexity, casinos often offer "suggested" or "fixed" way-keno games with the cost of the game and the payout schedule preprinted so that the player may just play the games published by the casino and doesn't need to make any calculations. For the same reasons, it is often difficult for the player to figure out if any money is won and how much. Because way-keno is so complex, most players avoid it and simply play regular keno.

It is desirable to provide a game of chance which provides more excitement than keno and way-keno, but which is simple enough to be played by the average gambler.

SUMMARY OF THE INVENTION

The present invention is directed at a method and device for playing a game similar to keno. The device comprising a video screen for displaying a playing board wherein the playing board comprises an array of squares, access for accepting a bet from a player, a selector for a player to select a pattern of squares on the playing board, a template generator, a random number generator for selecting, at random, squares within the playing board, a scanner to calculate the number of randomly selected squares which are included within the template for each different position in which the template is included within the playing board, a calculator for determining the payout for a winning position and for tallying the winnings and crediting the winnings to the player.

The method comprises preparing a template from the pattern of squares selected by the player, generating a random selection of squares on the playing board by the game, overlaying the template over the playing board in each possible position where the template will be included, counting the number of randomly selected squares contained within the template, determining the payout for each position, totaling the payouts derived from each of the winning positions and crediting the payouts to the player.

BRIEF DESCRIPTION OF THE DRAWINGS

The present invention will be described with reference to the accompanying drawings, wherein like reference numerals identify corresponding like components.

In the drawings:

FIG. 1*a* is a schematic of a keno grid;

FIG. 1*b* is a schematic of a keno grid in which five spots have been selected;

FIG. 1*c* is a schematic of a keno grid in which five spots have been selected and in which the keno device has randomly selected twenty numbers;

FIG. 2 is a schematic of a keno grid on which way-keno is being played;

DETAILED DESCRIPTION

The present invention is a game of chance which is similar to keno which is called, for convenience, "Pattern Keno." Pattern Keno involves the use of a playing board grid 26 (see FIG. 4) of, for example, eighty squares. However, unlike keno, the squares may be unnumbered since the numbers have no relevance in this game. Instead of playing specific numbers as shown in keno and way-keno, "patterns" of squares are used. Like way-keno, Pattern Keno involves playing multiple games simultaneously on a single playing board grid.

The payout schedule for Pattern Keno is based on the number of spots the player picks and the number of games to be played. The number of games to be played is based on how many ways the selected pattern will be included in the playing board grid.

Figure 3:
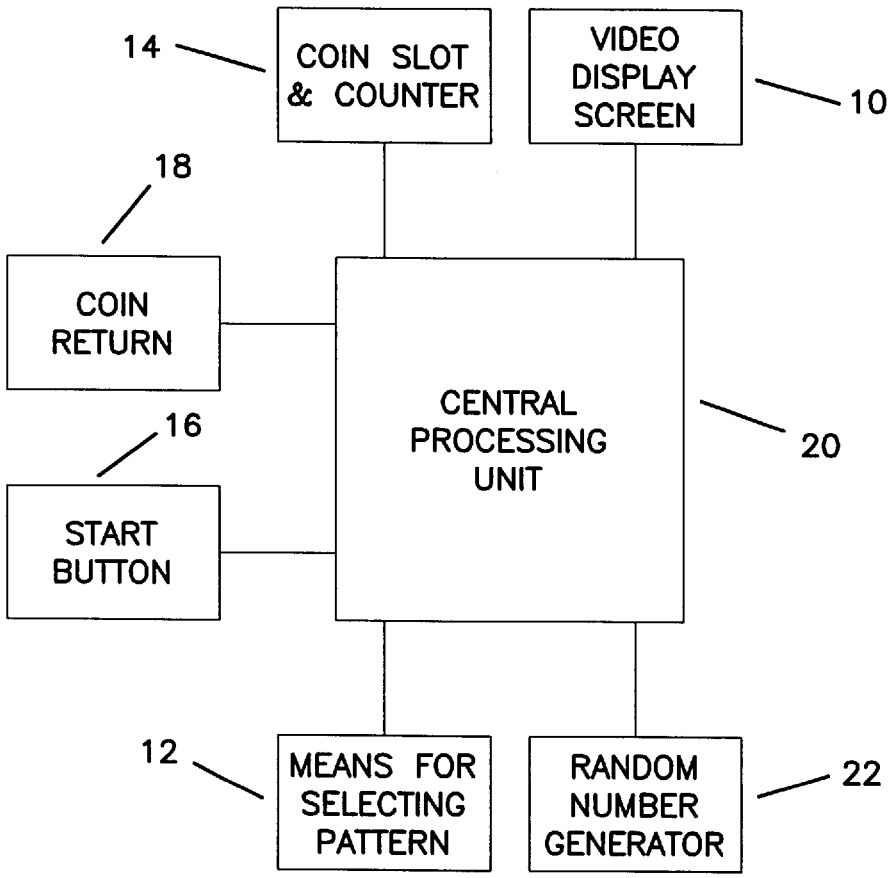
FIG. 3 is a schematic of a Pattern Keno video device.

Pattern Keno is preferably played on a video device to automate the calculations required to determine the number of wins received by the player. FIG. 3 shows the components of a video Pattern Keno device of the present invention. These components and their programming are well known to those skilled in the art.

The Pattern Keno device comprises a video display screen 10 for displaying the progress of the game and a means, such as a light pen, a mouse, touch screen or other similar device 12 for selecting the desired pattern 28 (see FIG. 4) of the player on the video display screen. The Pattern Keno device includes a coin slot and coin counter 14 for inserting coins. There may also be a similar device which accepts paper money for credits. Once the player is satisfied with the pattern chosen, start button 16 is pressed to initiate the game. At the end of the game, if the player has won, coins are returned to the player through coin return 18 or, alternatively, credited to the player. The components of the device, the video display screen, the means for selecting the player's desired pattern on the video display screen, the coin slot, the start button and the coin return are connected to a central processing unit (cpu) 20. The cpu is connected to a random number generator 22 for generating numbers to select squares within a playing board displayed on the video display screen. The playing board, in the embodiment of the invention shown in FIG. 4, comprises a ten-by-eight grid of squares, although other configurations of grid arrays are possible.

To play a game, the player deposits coins into the video gaming device or plays credits which have already been established by the player. The player may play any number of coins or credits (to a determined maximum). The payout odds for the game are multiplied by the number of coins or credits played. In the example of a ten-by-eight grid, a player can play a single credit and play up to sixty-three possible games (when a two-by-two square pattern is played, as an example) on that one credit, depending on the pattern played and the number of ways that pattern is included into the playing grid. If a player plays multiple coins or credits, the payout odds are enhanced. In one embodiment of the present invention, the player may use multiple coins to play multiple patterns simultaneously, with independent wagers on each pattern. In this version, the player picks multiple patterns and after the machine selects the squares at random, the machine scans each pattern across the grid, one after the next and adds winnings for each pattern independently.

The player selects squares to form a pattern from the playing board grid of eighty squares. When the player selects a square, it changes color so as to be distinguished from the unselected squares. If the player selects a square in error, the player may "unselect" the square, changing the square back to its original color. The player may select any squares from a minimum of four to a maximum of ten (the minimum and maximum limits are arbitrarily set for the purposes of explanation). In one embodiment of the present invention, the payout odds are displayed below the playing board grid. The payout odds are updated as each square is selected (or "unselected") by the player in sequence, until the player has determined enough squares have been selected for the game. In addition, the number of games the player is playing is also updated with each square selected (or "unselected"). The number of games played is the number of different positions in which the selected pattern will be included onto the playing board grid without overlapping the edges of the grid (the pattern must be fully contained within the grid). In one embodiment of the present invention, the pattern may overlap the edges of the playing grid to accommodate more positions for the selected pattern. In another embodiment of the present invention, the template "wraps" around the edges of the playing grid such that the template emerges on the opposite edge of the playing grid to accommodate a greater chance of winning. In one embodiment of the present invention, patterns are selected from a menu of pattern choices which are displayed on the video display screen.

The player may modify the pattern until the player is content with the pattern created. The pattern chosen does not need to be contiguous and a non-contiguous pattern is played with its separate parts always having the same relative spacial arrangement (see FIG. 5).

When the player is content with the pattern created, the player selects the start button. The pattern is then stored in the memory of the device and a template 30 (see FIG. 4) of the pattern is created and displayed. The video device then selects, for example, twenty squares in the playing board grid at random and displays the results by "coloring" or "lighting" the selected squares 32.

After the twenty squares are selected by the video device, the template of the selected pattern scans the playing board grid, covering each of the positions in which the template is included onto the playing board grid, searching for winning games. The template is an outline of the pattern selected and is used to show the player if the pattern selected matches any of the twenty randomly selected squares closely enough to be a winner as established by the payout odds that correspond to that game.

Once the template has "scanned" the entire playing board grid, the credits reflecting the winnings from the game are paid to the player and the player may go on to play additional games. The player may retain the pattern from the prior game played and play it again or may start afresh with a different pattern.

EXAMPLE 1

A pattern of squares is chosen by the player on the playing board as shown in FIG. 4. In this example, nine contiguous squares are chosen. The video would then display the parameters of the game as follows:

| | | | |
|---|---|---|---|
| Games | = | 48 | 9 out of 9 pays 10,000 |
| Spots | = | 9 | 8 out of 9 pays 119 |
| Credits | = | 9 | 7 out of 9 pays 5 |
| Wins | = | 0 | 6 out of 9 pays 1 |

Figure 4A:
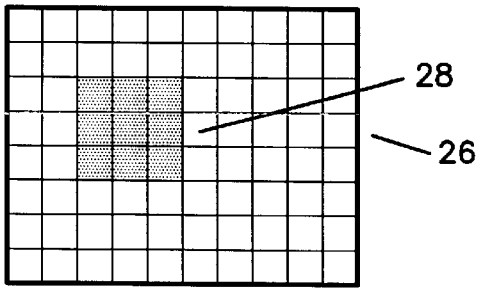
FIG. 4*a* is a schematic of a Pattern Keno grid on which the player has selected the pattern to be played.
Figure 4B:
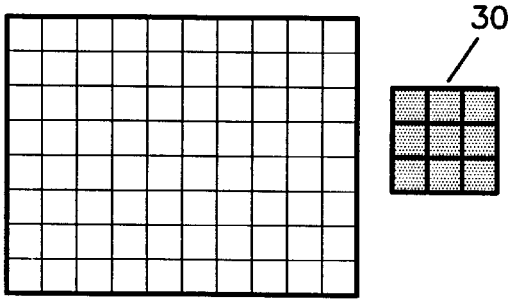
FIG. 4*b* is a schematic of a Pattern Keno grid on which the game has made a template of the player's pattern and placed the template to the side of the playing board.
Figure 4C:
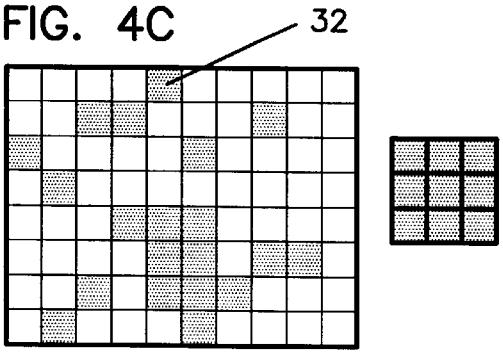
FIG. 4*c* is a schematic of a Pattern Keno grid on which the game has selected twenty random squares.
Figure 4D:
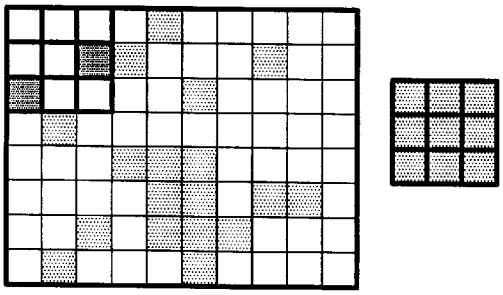
FIG. 4*d* is a schematic of a Pattern Keno grid on which the game has placed the template onto the first position on the grid to determine if a win has been achieved.
Figure 4E:
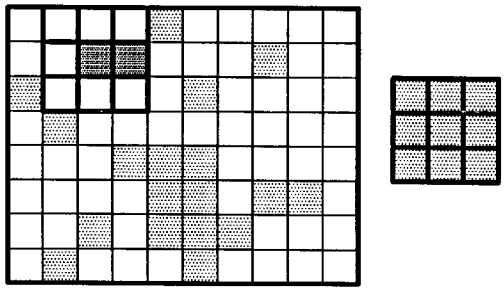
FIG. 4*e* is a schematic of a Pattern Keno grid on which the game has placed the template onto the second position on the grid to determine if a win has been achieved.

In this example, "Games=48" indicates that there are fourty-eight ways (or positions) in which the selected pattern will be included within the playing grid and so the player is playing 48 games simultaneously by selecting this pattern. "Spots=9" refers to the nine squares selected by the player which form the pattern. The player had ten credits but deposited one in order to play the game. The number of credits remaining after depositing the one credit is nine. The player then designs or selects a pattern to be played. When the player is content with the selected pattern (FIG. 4*a*), the player selects the start button. A template is made from the pattern selected by the player and placed to the side of the playing grid (FIG. 4*b*). Twenty squares are then selected at random from among the array of eighty squares displayed on the video device. The selected squares are "colored" to distinguish them from the non-selected squares (FIG. 4*c*) . After all twenty squares are selected, the template is placed on the first position of the playing board grid (in the upper-left corner in this example), including nine of the squares of the playing grid (FIG. 4*d*) and then scans the entire playing grid, covering every possible grouping of nine squares in the form of the template on the grid, so long as the template is always entirely within the playing grid with no portion of the template overlapping or extending over any of the edges of the playing grid. While scanning, the template searches for winning positions in which there are enough selected squares within the template to be a winning combination (in this example, at least six of the nine squares within the template must have been selected to be a winning combination). In this example, the template scans the playing grid starting in the upper-left corner, scans to the right until it can go no farther, then moves down one position, then scans to the left until it can go no farther, then moves down one position again and repeats this motion until it has scanned the entire playing grid. This is just an arbitrary example of the path that the template makes across the playing grid. The scanning may be done in any manner so long as it covers all possible playing positions. An illustration of the template scanning for a winner is shown in FIGS. 4*d–h*.

Figure 4F:
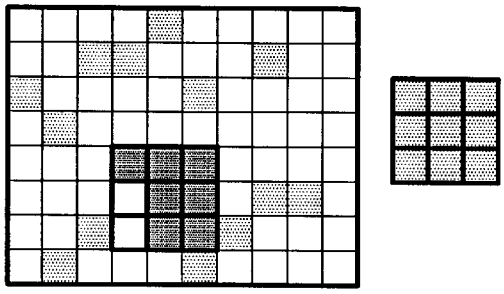
FIG. 4*f* is a schematic of a Pattern Keno grid on which the game has placed the template onto the thirty-sixth position on the grid to determine if a win has been achieved. At this position, there is a seven out of nine match, which is a winner for this pattern.
Figure 4G:
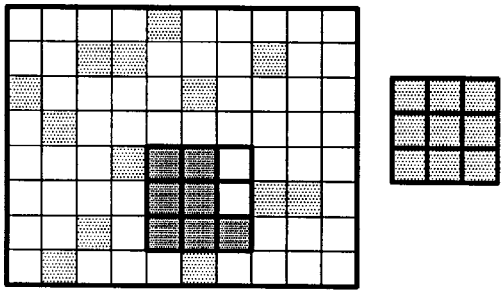
FIG. 4*g* is a schematic of a Pattern Keno grid on which the game has placed the template onto the thirty-seventh position on the grid to determine if a win has been achieved. At this position, there is another seven out of nine match, which is another winner.
Figure 4H:
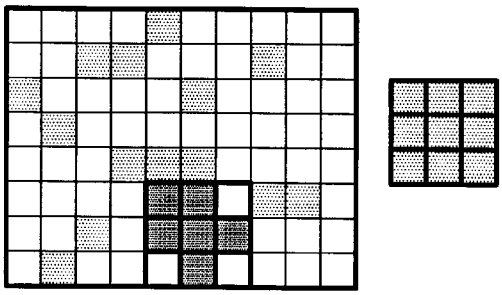
FIG. 4*h* is a schematic of a Pattern Keno grid on which the game has placed the template onto the forty-forth position on the grid to determine if a win has been achieved. At this position, there is a six out of nine match, which is also a winner for this pattern, which is the third winner for this game.

In this example game, there are three winners (FIGS. 4*f–h*). The template scans the grid back and forth until it comes across the first winner. The template then pauses, and in one embodiment of the invention, changes the color of the randomly selected squares that are enclosed within the template, tallies the winnings, returns the squares to their original color and then continues to scan for additional winners. The first winner is shown in FIG. 4*f*. The video displays the winning for this match as follows:

| | | | |
|---|---|---|---|
| Games | = | 48 | 9 out of 9 pays 10,000 |
| Spots | = | 9 | 8 out of 9 pays 119 |
| Credits | = | 14 | 7 out of 9 pays 5 |
| Wins | = | 5 | 6 out of 9 pays 1 |

The "7 out of 9 pays 5" line is highlighted to indicate the winning status that the template has discovered in this position. Seven out of nine of the squares in the pattern chosen by the player are among the squares selected at random when the pattern is in this position on the playing grid. The wins increases from zero to five because the player has won five credits with this win. "Wins=" indicates the aggregate winnings for all wins that the template finds in all positions of the playing grid. Similarly, the player's credits are increased from nine to fourteen because the player has won five credits with this win.

The template then continues to scan the grid until it comes across the second winner as shown in FIG. 4*g*. The video displays the winning for this match as follows:

| | | | |
|---|---|---|---|
| Games | = | 48 | 9 out of 9 pays 10,000 |
| Spots | = | 9 | 8 out of 9 pays 119 |
| Credits | = | 19 | 7 out of 9 pays 5 |
| Wins | = | 10 | 6 out of 9 pays 1 |

The second winner is also seven out of nine and so the player has won another five credits. The winnings are added to both the total wins and player's credits. The wins increase from five to ten and the player's credits increase from fourteen to nineteen.

Finally, the template continues to scan until the third winner is found and tabulated (FIG. 4*h*). The video displays the winning for this match as follows:

| | | | |
|---|---|---|---|
| Games | = | 48 | 9 out of 9 pays 10,000 |
| Spots | = | 9 | 8 out of 9 pays 119 |
| Credits | = | 20 | 7 out of 9 pays 5 |
| Wins | = | 11 | 6 out of 9 pays 1 |

The third winner is six out of nine and so, according to the pay schedule, the player has won one additional credit. The winnings are again added to both the total wins and player's credits. The wins increase from ten to eleven and the player's credits increase from nineteen to twenty.

The template continues scanning the rest of the grid but finds no additional winners for this game. This game is then over. The player has won a total of eleven credits from three winning positions (games).

EXAMPLE 2

Figure 5A:
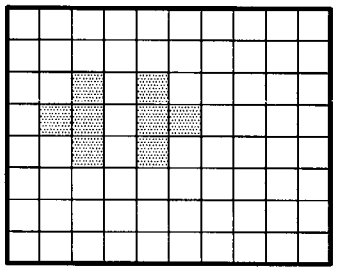
FIG. 5*a* is a schematic of a Pattern Keno grid on which the player has selected the pattern to be played.

A pattern of squares is chosen by the player on the playing grid as shown in FIG. 5*a*. In this example, eight non-contiguous squares (two groups of four) are chosen. The video would then display the parameters of the game as follows:

| | | | |
|---|---|---|---|
| Games | = | 36 | 8 out of 8 pays 1,800 |
| Spots | = | 8 | 7 out of 8 pays 86 |
| Credits | = | 9 | 6 out of 8 pays 2 |
| Wins | = | 0 | |

Figure 5B:
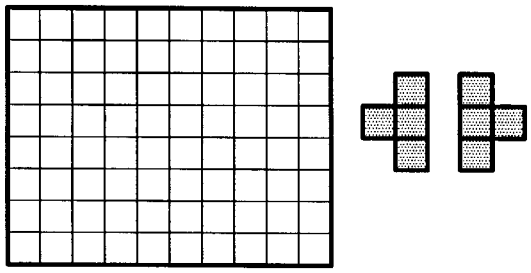
FIG. 5*b* is a schematic of a Pattern Keno grid on which the game has made a template of the player's pattern and placed the template to the side of the playing board.
Figure 5C:
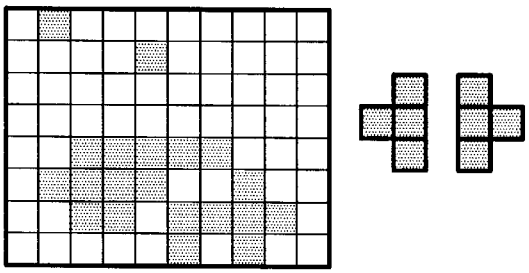
FIG. 5*c* is a schematic of a Pattern Keno grid on which the game has selected twenty random squares.
Figure 5D:
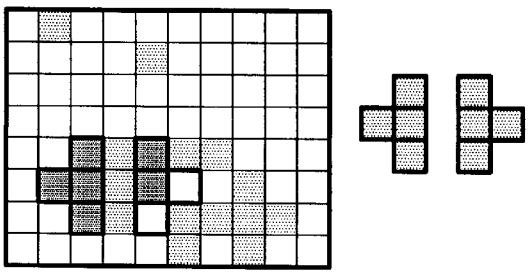
FIG. 5*d* is a schematic of a Pattern Keno grid on which the game is shown with the template scanning the squares and finding a win of six out of eight at position twenty-six for this game.

In this example, "Games=36" indicates that there are thirty-six ways (or positions) in which the selected pattern will be included within the playing grid and so the player is playing thirty-six games simultaneously by selecting this pattern. "Spots=8" refers to the eight squares selected by the player which form the pattern. The player had ten credits but deposited one in order to play the game. The number of credits remaining after depositing the one credit is nine. The player then designs or selects a pattern to be played. When the player is content with the selected pattern (FIG. 5*a*), the player selects the start button. A template is made from the pattern selected by the player and placed to the side of the playing grid (FIG. 5*b*). Twenty squares are then selected at random from among the array of eighty squares displayed on the video device. The selected squares are "colored" to distinguish them from the non-selected squares (FIG. 5*c*). After all twenty squares are selected, the template scans the entire playing grid, covering every possible grouping of eight squares in the form of the template on the grid, so long as the template is always entirely within the playing grid with no portion of the template overlapping or extending over any of the edges of the playing grid. In a non-contiguous pattern, such as in this example, the separate pieces of the pattern retain their same relative spacing with respect to each other while scanning. While scanning, the template searches for winning positions in which there are enough selected squares within the template to be a winning combination (in this example, at least six of the eight squares within the template must have been selected to be a winning combination). In this example, the template scans the playing grid starting in the upper-left corner, scans to the right until it can go no farther, then moves down one position, then scans to the left until it can go no farther, then moves down one position again and repeats this motion until it has scanned the entire playing grid. This is just an arbitrary example of the path that the template makes across the playing grid. The scanning may be done in any manner so long as it covers all possible playing positions. An illustration of the template scanning for a winner is shown in FIGS. 5*d–h*. The first winner is shown in FIG. 5*d*. The video displays the winning for this match as follows:

| | | | |
|---|---|---|---|
| Games | = | 36 | 8 out of 8 pays 1,800 |
| Spots | = | 8 | 7 out of 8 pays 86 |
| Credits | = | 11 | 6 out of 8 pays 2 |
| Wins | = | 2 | |

The wins increase from zero to two because the player has won two credits with this win and the player's credits likewise increase from nine to eleven.

Figure 5E:
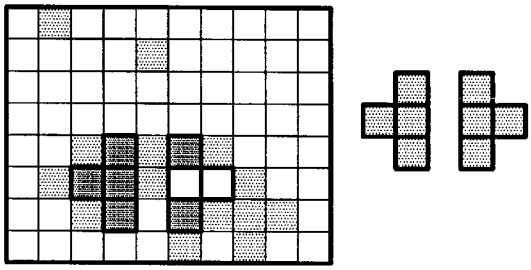
FIG. 5*e* is a schematic of a Pattern Keno grid on which the template has continued scanning the squares and has found another winner of six out of eight at position twenty-seven for this game.

The template then continues to scan the grid until it hits the second winner as shown in FIG. 5*e*. The video displays the winning for this match as follows:

| | | | |
|---|---|---|---|
| Games | = | 36 | 8 out of 8 pays 1,800 |
| Spots | = | 8 | 7 out of 8 pays 86 |
| Credits | = | 13 | 6 out of 8 pays 2 |
| Wins | = | 4 | |

The second winner is also six out of eight and so the player has won another two credits. The wins now increase from two to four and the player's credits increase from eleven to thirteen.

Figure 5F:
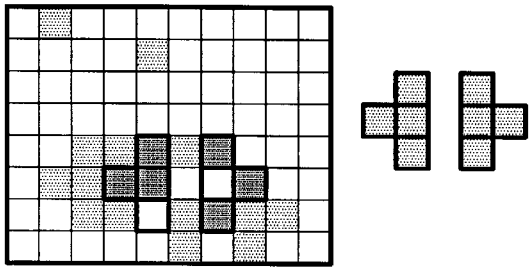
FIG. 5*f* is a schematic of a Pattern Keno grid on which the template has continued scanning the squares and has found another winner of six out of eight at position twenty-eight for this game.

The template continues to scan and finds the third winner (FIG. 5*f*). The video displays the winning for this match as follows:

| | | | |
|---|---|---|---|
| Games | = | 36 | 8 out of 8 pays 1,800 |
| Spots | = | 8 | 7 out of 8 pays 86 |
| Credits | = | 15 | 6 out of 8 pays 2 |
| Wins | = | 6 | |

The third winner is again six out of eight and so the player has won another two credits and the wins and credits each increase by another two.

Figure 5G:
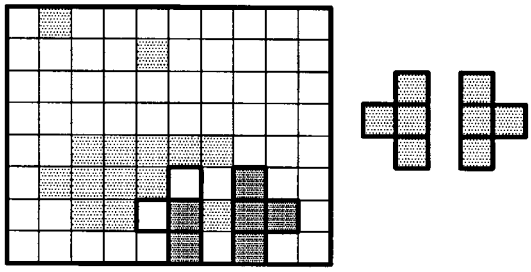
FIG. 5*g* is a schematic of a Pattern Keno grid on which the template has continued scanning the squares and has found another winner of six out of eight at position thirty-two for this game.

The template continues to scan and finds the fourth winner (FIG. 5*g*). The video displays the winning for this match as follows:

| | | | |
|---|---|---|---|
| Games | = | 36 | 8 out of 8 pays 1,800 |
| Spots | = | 8 | 7 out of 8 pays 86 |
| Credits | = | 17 | 6 out of 8 pays 2 |
| Wins | = | 8 | |

The fourth winner is again six out of eight and so the player has won another two credits and the wins and credits each increase by another two.

Figure 5H:
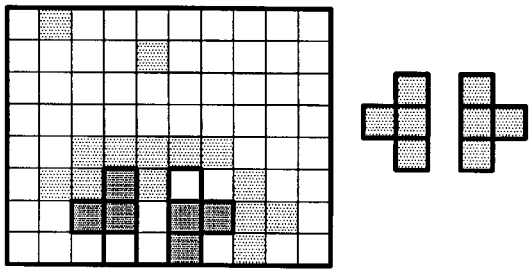
FIG. 5*h* is a schematic of a Pattern Keno grid on which the template has continued scanning the squares and has found another winner of six out of eight at position thirty-four for this game, which is the fifth winner for this game.

Finally, the template continues to scan until the fifth winner is found and tabulated (FIG. 5*h*). The video displays the winning for this match as follows:

| | | | |
|---|---|---|---|
| Games | = | 36 | 8 out of 8 pays 1,800 |
| Spots | = | 8 | 7 out of 8 pays 86 |
| Credits | = | 19 | 6 out of 8 pays 2 |
| Wins | = | 10 | |

The fifth winner is once again six out of eight, the player has won another two credits and the wins and credits once again increase by two each.

The template continues scanning the rest of the grid but finds no additional winners for this game. This game is then over. The player has won a total of ten credits from five winning positions (games).

Pattern Keno offers many advantages to keno and way-keno. Pattern Keno is much simpler to play than way-keno. Pattern Keno involves simple pattern recognition. Simply play a coin, select any pattern, press go. If enough of the pattern is found anywhere on the playing grid, the player wins. Way-keno often involves complicated math just to calculate how many games are being played and how much money is being played. In fact, because of its complexity, the casinos often offer "suggested" or "fixed" way-keno games with the cost of the game and the payout schedule pre-printed so that the player just plays the games published by the casino and doesn't need any calculations. For the same reasons, it is often difficult for the player to calculate if any money is won and how much. Due to its complexity, most players avoid way-keno and simply play regular keno. Pattern Keno is exciting because the player can see a winner forming as the squares are selected at random on the playing grid. It also adds an extra element of excitement as the template scans the playing grid, searching for a winner.

Other advantages of the Pattern Keno game, over other keno games, are as follows:

The Pattern Keno game is dynamic with the template scanning the playing grid, searching for winners. In both keno and way-keno the player is playing specific numbers and after the numbers are chosen, the game is "static."

The payout odds are also flexible in Pattern Keno with payout odds being adjusted according to the number of ways the selected pattern can be included in the playing grid. For example, one 5-spot game may have different payout odds than another 5-spot game, depending on the pattern chosen. In effect, the player can manipulate the payout odds by selecting different patterns. In keno and way-keno, the payout odds remain the same between games that have the same number of spots chosen.

Pattern Keno is unlimited. The player can pick any pattern where the number of spots selected falls between the determined minimum and maximum. In way-keno, combinations of grouped numbers are used. If too many groups are selected, the number of combinations of games being played becomes confusing.

The present invention is not to be limited to the specific embodiments shown which are merely illustrative. Various and numerous other embodiments may be devised by one skilled in the art without departing from the spirit and scope of this invention. For example, "squares" are used for illustrating the game although other shaped playing areas within the grid could also be used. Also, a template can be included within the playing board by "wrapping" around the edges of the playing grid such that the template emerges on the opposite edge of the playing grid to increase the chances of winning or the template can be included by not "wrapping" around the edge of the board to reduce the chances of winning. Also, if desired, the positions in which the template is included may be designated by the operator of the game to reduce or increase the chances of winning and may not include all possible positions, as desired. The scope of this invention is defined in the following claims.

What is claimed is:

1. A method of playing a game having a playing board divided into a desired number of squares, a means for a player to select a pattern of squares on the playing board and a means for generating a random selection of squares on the playing board, comprising:

preparing a template from the pattern of squares selected by the player;

generating a random selection of squares on the playing board by the game;

overlaying the template over the playing board, in each of the positions where the template is included;

counting the number of randomly selected squares contained within the template;

determining the payout; and crediting the payouts to the player.

2. The method as recited in claim 1 wherein the playing board consists of an array of eighty squares in an arrangement of 8×10.

3. The method as recited in claim 2 wherein twenty squares are randomly selected by the game.

4. The method as recited in claim 2 wherein four to ten of the squares on the playing board are selected by the player.

5. The method as recited in claim 1 wherein the squares selected by the player are selected from the group consisting of contiguous and noncontiguous squares.

6. The method as recited in claim 5 wherein the template retains the spatial arrangement of the pattern of squares chosen.

7. The method as recited in claim 1 wherein the playing board is displayed on a video screen.

8. The method as recited in claim 1 wherein the pattern of squares selected by the player are displayed on the video screen.

9. A method of playing a game having a playing board comprising a grid of eighty squares arranged in an 8×10 array, means for a player to select a pattern of between four and ten squares on the playing board and a random number generator for selecting twenty squares from the grid at random, comprising:

a. preparing a template from the pattern of squares selected by the player;

b. generating a random selection of twenty squares on the playing board by the game;

c. overlaying the template over the playing board at a first position;

d. counting the number of randomly selected squares contained within the template at the first position;

e. determining the payout for the first position;

f. moving the template to a next position;

g. counting the number of randomly selected squares included within the template at the next position;

h. determining the payout for the next position;

i. repeating steps f. to h. until all the different positions in which the template will be included on the board have been scanned;

j. totaling the payouts derived from the each of the positions; and k. crediting the payouts to the player.

10. The method as recited in claim 9 wherein the squares selected by the player are selected from the group consisting of contiguous and noncontiguous squares.

11. The method as recited in claim 10 wherein when a noncontiguous pattern of squares is chosen the template retains the relative spatial arrangement of the pattern of squares.

12. The method as recited in claim 9 wherein the playing board is displayed on a video screen.

13. The method as recited in claim 9 wherein the pattern of squares selected by the player are displayed on the video screen.

14. A device for playing a game comprising:

a video screen for displaying a playing board wherein the playing board comprises an array of squares;

means for accepting a bet from a player;

means for a player to select a pattern of squares on the playing board;

means for generating a template from the pattern chosen by the player;

a random number generator for selecting, at random, squares within the playing board;

means for scanning the playing board with the template to calculate the number of randomly selected squares which are included within the template for each different position in which the template is included within the playing board;

means for calculating the payout for a winning position;

means for tallying the winnings; and means for crediting the winnings to the player.

15. The device as recited in claim 14 wherein the playing board consists of an array of eighty squares in an arrangement of 8×10.

16. The device as recited in claim 15 wherein twenty squares are randomly selected by the game.

17. The device as recited in claim 15 wherein a minimum of four to a maximum of ten squares are selected by the player.

18. The device as recited in claim 14 wherein the squares selected by the player are selected from the group consisting of contiguous and noncontiguous squares.

19. The device as recited in claim 18 wherein when a noncontiguous pattern of squares is chosen the template retains the relative spatial arrangement of the pattern of squares.

* * * * *